United States Patent [19]

Crutcher

[11] 4,081,953

[45] Apr. 4, 1978

[54] HYBRID HOROLOGICAL DISPLAY USING SPACE MODULATION

[75] Inventor: William C. Crutcher, Middlebury, Conn.

[73] Assignee: Timex Corporation, Waterbury, Conn.

[21] Appl. No.: 754,205

[22] Filed: Dec. 27, 1976

[51] Int. Cl.[2] ..... G04C 3/00; G04C 17/00

[52] U.S. Cl. ..... 58/50 R; 58/127 R

[58] Field of Search ..... 58/23 R, 50 R, 127 R

[56] References Cited

U.S. PATENT DOCUMENTS

| | | | |
|---|---|---|---|
| 3,738,099 | 6/1973 | Tanaka | 58/50 R X |
| 3,754,392 | 8/1973 | Daniels | 58/50 R |
| 3,922,847 | 12/1975 | Culley et al. | 58/50 R |
| 3,978,296 | 8/1976 | Moriya et al. | 58/23 R X |
| 3,982,387 | 9/1976 | Tanaka | 58/50 R |
| 3,992,875 | 11/1976 | Kashio | 58/50 R |
| 4,007,583 | 2/1977 | Johnson | 58/50 R |

*Primary Examiner*—Stanley J. Witkowski
*Attorney, Agent, or Firm*—William C. Crutcher

[57] ABSTRACT

A solid state watch with electrooptic display employs digital indication of hours and five minute radial markers for indication of minutes. A first selected marker is actuated during five minute intervals and second markers are modulated in varying spaced relationship to the first marker, so as to give an indication of the degree of passage of time during five minute intervals.

5 Claims, 7 Drawing Figures

HYBRID HOROLOGICAL DISPLAY USING SPACE MODULATION

BACKGROUND OF THE INVENTION

This invention relates generally to solid state electronic timepieces with electrooptic displays, and more particularly relates to an improved circuit and display arrangement for indicating the hours and minutes in digital and "analog" fashion respectively.

Electronic solid state watches with electrooptic displays, such as light-emitting diode displays or liquid crystal displays have generally favored the presentation of the time in digits. One reason for this is that a digit can be presented with seven individually actuatable segments requiring seven leads between the display and the electronic circuit. Hours and minutes can be displayed using four digits. Examples of such timepieces are found in U.S. Pat. No. 3,863,436 — Schwarzschild et al, issued Feb. 4, 1975 and in U.S. Pat. No. 3,953,964 — Suppa et al, issued May 4, 1976, both assigned to the present assignee and exemplary of this type of watch.

On the other hand, when efforts have been made to display the hours and minutes on an electrooptic display in so-called "analog" fashion, i.e., representing the conventional hour hand and minute hand of a watch electronically, considerable technological difficulties are encountered. This is primarily due to the multiplicity of individual marker segments on the periphery of the display and the number of leads required, sixty in all, to display the minutes. Various efforts have been made to overcome this, as exemplified in U.S. Pat. No 3,922,847 — Culley et al, issued Dec. 2, 1975 or U.S. Pat. No. 3,955,354 — Kilby et al, issued May 11, 1976. The foregoing utilize concentric rings and use different color LEDs or sharing of the same markers for hours, minutes and seconds, respectively.

Other approaches to indicating minutes by radially disposed markers on an electrooptic display have employed techniques for dividing the minutes segments into groups and employing special switching techniques as exemplified in U.S. Pat. No. 3,987,617, issued Oct. 26, 1976 to A. Slob; U.S. Pat. No. 3,934,241, issued Jan. 20, 1976 to H. Weigert; and German Offenlegungsschrift No. 2,410,527 — K. K. Suncrux Research Office.

Still other related approaches employ separate concentric rings of lights or markers as in U.S. Pat. No. 3,456,152 — Andersen, issued July 15, 1969; U.S. Pat. No. 3,844,105 — Kashio, issued Oct. 29, 1974; U.S. Pat. No. 3,258,906 — Demby , issued July 5, 1966; U.S. Pat. No. 3,626,410 — deKoster, issued Dec. 7, 1971 and Swiss Pat. No. 437,532 — S.S.I.H. published Nov. 30, 1967. Assignee's U.S. Pat. No. 3,540,209 to Zatsky et al, issued Nov. 17, 1970 further illustrates a liquid crystal display for giving an "analog" time indication.

The basic problem with approaches in the prior at is that of circuit complexity and space requirements, as well as difficulty and expense involved in providing the many minute connections to the display.

Hybrid horological displays have been suggested which utilize both digits and radial markers for hours and minutes, respectively. An example is seen in applicant's U.S. Design Pat. No. D242,694, issued Dec. 14, 1976 in the names of Thompson and Sheffield. Improvements in reducing the complexity of the circuits for displaying minutes, as well as reducing the number of actuatable segments required, would greatly simplify solid state electronic watches.

Suggestions have been made for adding "ten seconds" indicators on a conventional hours and minutes digital watch as in U.S. Pat. No. 3,982,387 — Tanaka, issued Sept. 28, 1976.

Accordingly, one object of the present invention is to provide an improved horological display utilizing a reduced number of segments in an electrooptic display.

Another object of the invention is to provide an improved display for indicating minutes by radially disposed markers and requiring fewer segments than in the prior art to indicate the passage of time from one minute to the next.

Another object of the invention is to provide an improved hybrid horological display and modulating/-driving circuit for the display.

DRAWINGS

The invention, both as to organization and method of practice, together with further objects and advantages thereof, will best be understood by reference to the following specification, taken in connection with the accompanying drawings, in which.

SUMMARY OF THE INVENTION

Briefly stated, the invention is practiced by providing, in a timepiece of the type having a time base, a countdown dividing circuit, and a decoder/driver actuating an electrooptic digit display for the hours, the improvement comprising a minutes displaying having selectively actuatable markers, and a modulator/ driver for selectively actuating a first said markers over a five minute interval and second of said markers in varying spaced relationship to the first marker, so as to indicate the degree of time passage during five minute intervals.

DESCRIPTION OF THE PREFERRED EMBODIMENT

Figure 1:
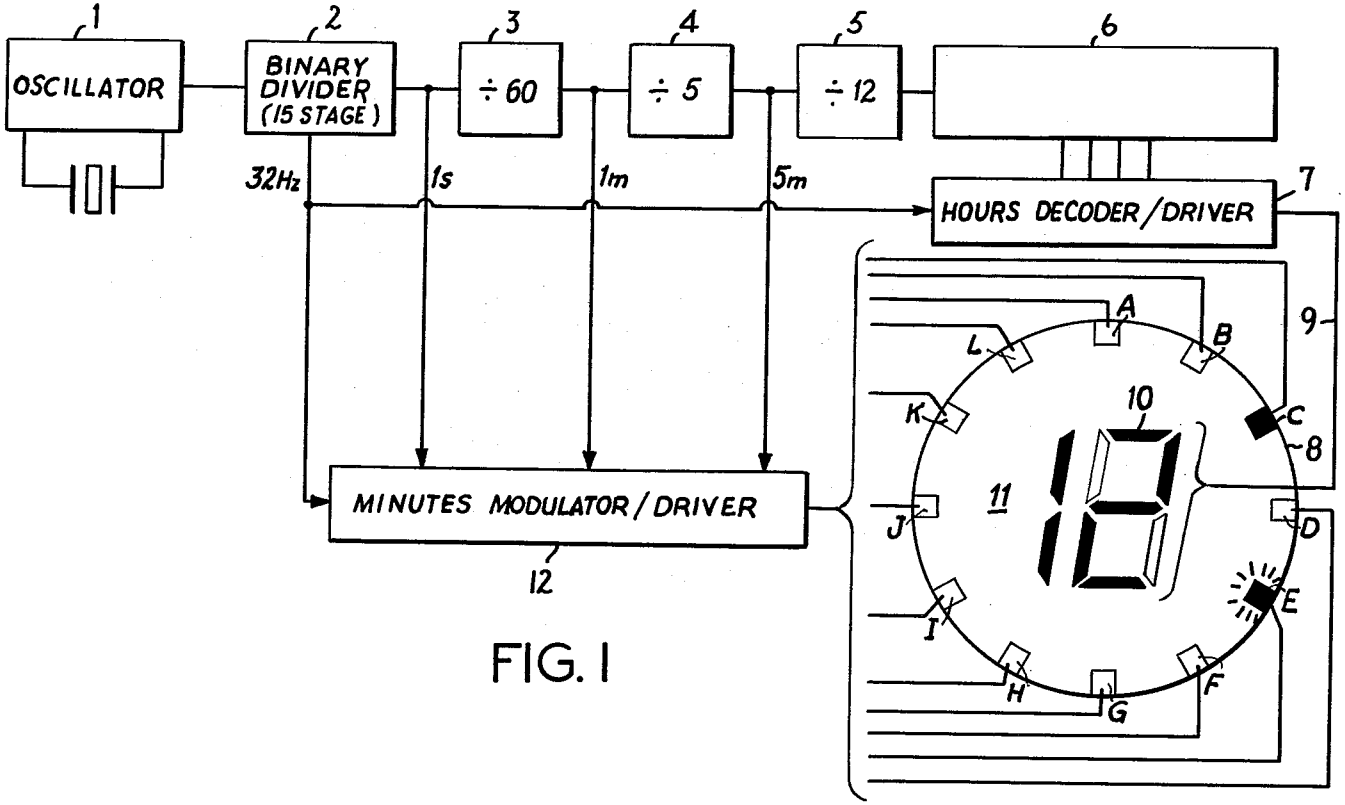
FIG. 1 is a simplified schematic diagram of the watch circuit and display.

Referring now to FIG. 1 of the drawing, the conventional elements in the arrangement, which are well-known in the art, include a high frequency time base comprising a quartz crystal oscillator 1, a countdown dividing circuit including a binary divider 2 for reducing the quartz crystal frequency to a time indication frequency for visual display (1 Hz in the present case), a "second" counter 3 arranged to give an output pulse each minute, a counter 4 giving an output each five minutes, and a divide by twelve counter 5 giving an output pulse once per hour, and lastly an "hours" counter 6 providing a binary output signal to an hours decoder/drivers 7. Time is indicated on an electrooptical display 8, having selectively actuatable segments or markers. The decoder/driver 7 is provided with multiple output leads, illustrated here for simplicity by a single lead 9, connected to the individual segments, such as segment 10, of the "hours" digits 11 in the center of the display.

The display 8 can be any desired type of electrooptic display, such as light-emitting diode, liquid crystal, or electrochromic. Such displays are well-known in the art and, upon selected actuation of a segment such as 10, it will become dark or colored, whereas the unactuated segments are transparent or invisible with respect to the background.

Referring to the portions of FIG. 1 illustrating the improvement of the present invention, radially disposed markers A – L (twelve in all), located surrounding the digits 11 at the conventional "five minute" marker locations in a conventional timepiece, are provided with leads connected to a "minutes" modulator/driver 12. Modulator/driver 12 is connected to the outputs of dividers and counters 2, 3, 4 to receive a one second pulse "1*s*", a one minute pulse "1*m*" and a five minute pulse "5*m*". The preferred embodiment shown is adapted for a liquid crystal display. A 32 Hz pulse taken from the binary divider 2 is applied as a polarity reversing driver pulse to the conventional decoder/driver 7 and to the minutes modulator/driver 12.

In accordance with the preferred form of the present invention, as will be set forth in greater detail, the minutes modulator/driver 12 displays minutes by means of a steady indication "S" on a first selected marker such as A – L. A second marker indicates the passage of time from one five minute interval to the next. This latter indication is accomplished by a pulsing indicator "P" which is "stepped" around from the steady marker.

Figure 2:
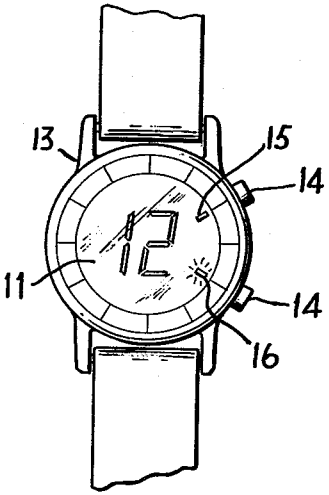
FIG. 2 is a plan view of a watch with electrooptic display employing the invention, FIG. *2a* - *2d* are simplified views of the display of FIG. 2 at consecutive one minute intervals.
Figure 2A:
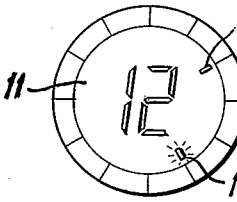
Figure 2B:
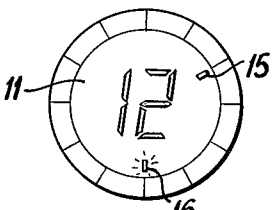
Figure 2C:
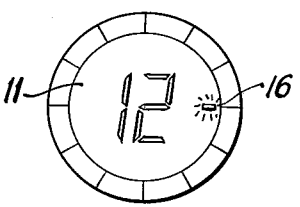
Figure 2D:
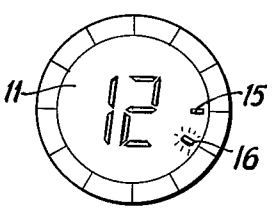

FIG. 2 of the drawing illustrates a complete watch with a case 13, appropriate push buttons for setting or updating the time, and displaying the time 12:12 on display 11. The steady marker "S" is shown at reference numeral 15 while the pulsating or flashing marker "P" is shown at reference numeral 16.

FIGS. 2*a* – 2*d* illustrate the passage of time from 12:13 through 12:16. The "P" marker progressively steps around from the "S" marker until the time 12:15 is reached. This is shown by flashing a single marker. Then the 12:15 marker becomes a steady marker and a pulsing marker commences the cycle again to indicate passage of time from 12:15 to 12:20.

Figure 3:
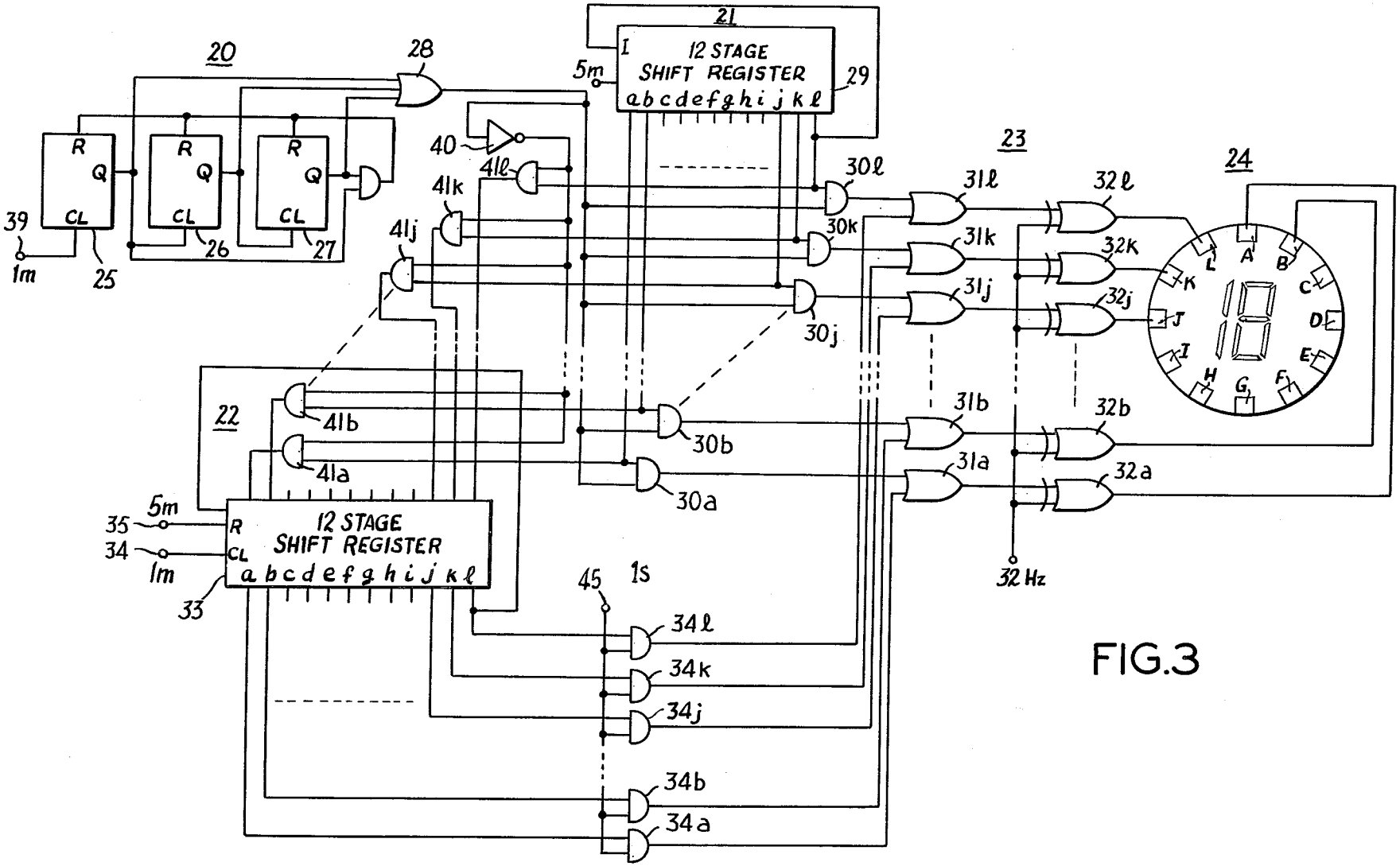
FIG. 3 is a simplified logic diagram of the modulator for the minutes portion of the display.

Referring to FIG. 3 of the drawing, the details of one suitable modulator/driver for minutes is illustrated. The logic circuit shown accomplishes modulation of the "minutes" markers A – L over a period of time from 00 – 60 minutes in accordance with the following table.

| | ANALOG SEGMENTS | | | | | | | | | | | |
|---|---|---|---|---|---|---|---|---|---|---|---|---|
| | A | B | C | D | E | F | G | H | I | J | K | L |
| 00 | P | | | | | | | | | | | |
| 01 | S | P | | | | | | | | | | |
| 02 | S | | P | | | | | | | | | |
| 03 | S | | | P | | | | | | | | |
| 04 | S | | | | P | | | | | | | |
| 05 | | P | | | | | | | | | | |
| 06 | | S | P | | | | | | | | | |
| 07 | | S | | P | | | | | | | | |
| 08 | | S | | | P | | | | | | | |
| 09 | | S | | | | P | | | | | | |
| 10 | | | P | | | | | | | | | |
| 11 | | | S | P | | | | | | | | |
| 12 | | | S | | P | | | | | | | |
| 13 | | | S | | | P | | | | | | |
| 14 | | | S | | | | P | | | | | |
| 15 | | | | P | | | | | | | | |
| 16 | | | | S | P | | | | | | | |
| 58 | | | P | | | | | | | | | |
| 59 | | | | P | | | | | | | | |
| 00 | P | | | | | | | | | | | |

As can be seen from the foregoing table, the steady segment signals "S" are enabled during four minutes of each five minute interval and also advanced from one marker to the next in five minute intervals. The pulsing segments "P" advance from one marker to the next over five minute intervals, then repeat the cycle again, commencing with the marker following that on which the previous cycle commenced.

In the upper portion of FIG. 3, the logic circuitry for the steady pulse is indicated by an "enable" section 20 and an "advance" section 21. The lower portion of FIG. 3 includes a cycling section 22 for the pulsing signals. Signal combining and driving stages are shown at 23 connected to the display at 24.

Referring first to the "enable" section 20, the J – K flip-flops are connected as shown with outputs to an OR gate 28 and the input clock pulse 1m is applied at input 39. As successive pulses are applied at 39, the output from OR gate 28 is successively off, on, on, on, on, off, on, on, etc.

To advance the steady signal, a twelve-stage shift register 29 is arranged with twelve outputs connected to the inputs of AND gates 30 (a through l). The other inputs of AND gates 30 are connected in parallel to the output of OR gate 28. The outputs of AND gates 30 are, in turn, connected respectively as one input of OR gates 31 (a through l). Outputs from the OR gates 31 are connected respectively as one input to driver/amplifiers 32 (a through l). The other input to the amplifier 32 is a 32 Hz pulse for polarity reversal associated with driving the liquid crystal display.

Referring to the lower portion of FIG. 3, a twelve stage shift register 33 has twelve outputs and parallel inputs connected to the respective twelve outputs of shift register 29. Shift register 33 is clocked by the one minute pulse lm supplied at terminal 34 and reset at 5 minute intervals by pulse 5m at input terminal 35. When one of the twelve parallel inputs to register 33 is enabled, a one minute clock pulse causes the signal to shift successively from one stage to the next in register 33. An output from an inverter 40 together with a respective output from shift register 29 is applied to AND gates 41 (*a* – *l*), and the outputs from AND gates 41 connected to the respective parallel inputs of register 33. One of the twelve inputs of register 33 is thus enabled during the first minute of a five minute interval.

At five minute intervals, the shift register is reset. The next successive parallel input is enabled by register 29 and the clock pulse moves through the next five stages of register 33 commencing one stage farther down in the shift register than that at which it previously commenced. Reference to the foregoing table indicates movement of the "S" outputs through register 33.

The outputs from register 33 are applied as respective inputs to AND gates 34 (*a* – *l*). The other inputs to AND gates 34 is a one second pulse 1s applied at terminal 35. The outputs from AND gates 34 are applied as inputs to the respective OR gates 31.

Operation

The steady signal "S" is enabled at the output of OR gate 28, successively advanced by shift register 29, and applied to OR gates 31. The second signal is repetitively recycled through the shift register 33 and also advanced at five minute intervals. The outputs from shift register 33 are caused to flash at one second intervals by pulse 1*s* enabling AND gates 34, and "P" signal is applied to the OR gates 31. A signal at either input to one of the OR gates 31 will actuate the drivers 32 and selectively actuate the markers A – L according to the pattern described above.

Thus, there has been described an improved display which indicates the extent of passage of time from one minute to the next using only twelve radial markers on the watch display.

Although a particular arrangement is shown using flip-flops, shift registers and gates to provide the desired modulation pattern, a ROM could be also employed programmed to receive inputs from a 60 minute counter, a 1 Hz input and a 32 Hz input. The ROM output would be connected to the twelve minute markers A – L. The design of the foregoing alternate is within the knowledge of one skilled in the art. The time elapsed between actuation of a first steady five minute marker is visually accomplished by modulating a second flashing marker in spaced relationship to the steady marker.

While there has been described herein the preferred embodiment of the invention, it is desired to encompass in the appended claims all such modifications as fall within the true spirit and scope of the invention.

I claim:

1. In an electronic timepiece of the type having a time base, a countdown dividing circuit connected to the output thereof, and a decoder/driver connected to the output of said dividing circuit and actuating an electrooptic display of digits for the hours, the improvement comprising a minutes display having twelve selectively actuatable markers, and a modulator/driver for selectively actuating a first of said markers during a five minute interval and second ones of said markers in varying spaced relationship to the first marker so as to indicate the passage of minutes during five minute intervals.

2. The combination according to claim 1, wherein said markers are radially disposed around said digits and uniformly spaced to indicate five minute intervals.

3. The combination according to claim 1, wherein said first marker is actuated to give a steady indication during a portion of a five minute interval, and wherein a second marker is actuated to give a flashing signal over said portion of the interval.

4. The combination according to claim 1 wherein said second markers are stepped at successively changing distances from said first marker to indicate the degree of passage of time during intervals.

5. The combination according to claim 1, wherein said modulator/driver includes a first circuit for generating a first steady signal for one of the first markers over an interval, and a second circuit for generating and successively advancing a pulsating signal from one of the second markers to the next during said interval, said first and second circuits being connected through gating means and driver means to said display markers.

* * * * *